US011401768B2

(12) United States Patent
Kardec et al.

(10) Patent No.: US 11,401,768 B2
(45) Date of Patent: Aug. 2, 2022

(54) METHOD OF AND SYSTEM FOR CONNECTING TO A TUBING HANGER

(71) Applicant: AKER SOLUTIONS AS, Lysaker (NO)

(72) Inventors: Alan Kardec, Parana (BR); Alexandre Augusto, Parana (BR); Felipe Ehike Anastacio, Parana (BR); Henrique Mello, Parana (BR); Marcel Toledo, Parana (BR); Michel Rehem, Parana (BR)

(73) Assignee: AKER SOLUTIONS AS, Lysaker (NO)

( * ) Notice: Subject to any disclaimer, the term of this patent is extended or adjusted under 35 U.S.C. 154(b) by 0 days.

(21) Appl. No.: 17/040,987

(22) PCT Filed: Apr. 10, 2019

(86) PCT No.: PCT/NO2019/050076

§ 371 (c)(1),
(2) Date: Sep. 24, 2020

(87) PCT Pub. No.: WO2019/199177

PCT Pub. Date: Oct. 17, 2019

(65) Prior Publication Data

US 2021/0324698 A1 Oct. 21, 2021

(30) Foreign Application Priority Data

Apr. 10, 2018 (NO) ..... 20180488

(51) Int. Cl.
*E21B 33/043* (2006.01)

(52) U.S. Cl.
CPC ..... *E21B 33/043* (2013.01)

(58) Field of Classification Search
CPC ..... E21B 33/043
See application file for complete search history.

(56) References Cited

U.S. PATENT DOCUMENTS 6,200,152 B1 * 3/2001 Hopper ..... E21B 33/03 439/310
6,494,266 B2 * 12/2002 Bartlett ..... F16K 3/0218 166/339
7,350,580 B1 * 4/2008 Laureano ..... E21B 33/0355 137/607
8,336,629 B2 12/2012 Vaynshteyn et al.
(Continued)

FOREIGN PATENT DOCUMENTS

EP 3 399 140 A2 11/2018
NO 20170181 A1 * 10/2016

*Primary Examiner* — Aaron L Lembo
(74) *Attorney, Agent, or Firm* — Norman B. Thot

(57) ABSTRACT

A method of connecting a tubing hanger mounted in a subsea wellhead to equipment which is external to the tubing hanger. The method includes securing the tubing hanger to an end of a drill string using a tubing hanger running tool assembly, lowering the drill string from a drilling rig so as to land the tubing hanger on or in the wellhead, running an umbilical from the sea surface to the wellhead, and connecting the umbilical to at least one conduit in the tubing hanger via the tubing hanger running tool assembly. The umbilical is unconnected to the drill string other than via the tubing hanger running tool assembly.

14 Claims, 5 Drawing Sheets

(56) References Cited

U.S. PATENT DOCUMENTS

| | | | | |
|---|---|---|---|---|
| 8,443,899 | B2 | 5/2013 | June et al. | |
| 8,590,625 | B1 * | 11/2013 | Smith | E21B 33/0407 166/344 |
| 8,668,004 | B2 * | 3/2014 | June | E21B 33/043 166/88.4 |
| 9,556,685 | B2 * | 1/2017 | Blanchard | E21B 17/01 |
| 10,837,251 | B2 * | 11/2020 | Foley | E21B 33/0422 |
| 10,890,043 | B2 * | 1/2021 | Carlsen | E21B 33/0355 |
| 11,105,172 | B2 * | 8/2021 | Aga | E21B 34/04 |
| 2003/0141071 | A1 | 7/2003 | Hosie | |
| 2005/0269096 | A1 * | 12/2005 | Milberger | E21B 17/026 166/308.1 |
| 2006/0042791 | A1 | 3/2006 | Hosie et al. | |
| 2007/0246220 | A1 * | 10/2007 | Fenton | E21B 33/04 166/344 |
| 2008/0110633 | A1 | 5/2008 | Trewhella | |
| 2012/0097383 | A1 | 4/2012 | Fenton | |
| 2013/0056219 | A1 | 3/2013 | Miller | |
| 2015/0252635 | A1 | 9/2015 | Hartley et al. | |
| 2017/0350209 | A1 * | 12/2017 | Hestetun | E21B 47/008 |
| 2018/0320470 | A1 | 11/2018 | Foley et al. | |

* cited by examiner

METHOD OF AND SYSTEM FOR CONNECTING TO A TUBING HANGER

CROSS REFERENCE TO PRIOR APPLICATIONS

This application is a U.S. National Phase application under 35 U.S.C. § 371 of International Application No. PCT/NO2019/050076, filed on Apr. 10, 2019 and which claims benefit to Norwegian Patent Application No. 20180488, filed on Apr. 10, 2018. The International Application was published in English on Oct. 17, 2019 as WO 2019/199177 A1 under PCT Article 21(2).

FIELD

The present invention relates to a method of and to a system for providing hydraulic and/or electrical connections to a tubing hanger installed on a wellhead.

BACKGROUND

It is known to mount a tubing hanger on the wellhead during the drilling of a wellbore for oil and/or gas production or during the completion process for bringing the wellbore into production. The tubing hanger is typically mounted in a production adapter base or in a tubing head spool which is mounted on the wellhead. The tubing hanger is provided to support the production tubing string.

A schematic illustration of an example of a prior art system 10 for landing a tubing hanger on a subsea wellhead is illustrated in FIG. 1. FIG. 1 shows a tubing hanger 12, a tubing hanger running tool 14, a shear joint 16, a crossover 18, a drill string 20, a riser 22, a drilling rig 24, an umbilical 26, a wellhead 28, a seabed 30, a production adapter base 32, and a blowout preventer (BOP) stack 34 containing a ram-type BOP 36.

To install the tubing hanger 12, the tubing hanger 12 is typically mounted on a tubing hanger running tool 14 which is suspended from a drill string 20 via a shear joint 16, and a crossover 18. The shear joint 16 is a portion of tubular which is capable of being sheared using a ram-type BOP 36. The drill string 20 is lowered down a riser 22 which extends from a drilling rig 24 to a blowout preventer (BOP) stack 34 mounted on a production adapter base 32 (also known as a tubing hanger spool) on top of the wellhead 28, until the tubing hanger 12 is landed in the internal profile of the production adapter base 32, and the shear joint 16 is aligned with a ram-type BOP 36 in the blowout preventer (BOP) stack 34. In an emergency situation, the ram-type BOP 36 can be operated to sever the drill string 20 and release the tubing hanger 12 and tubing hanger running tool 14, the ram-type BOP 36 thereby sealing the well bore and allowing the drill string 20 to be withdrawn from the riser 22.

It is known to provide the tubing hanger 12 with ports for hydraulic and electrical connection to the surface when the tubing hanger 12 is mounted on a subsea wellhead 28. The electrical connections may, for example, be used to provide power to electrical sensors mounted on the tubing hanger 12. The hydraulic connections may provide means for operating downhole safety valves or may provide a port for the injection of chemicals into the wellbore. These ports are connected to an electrohydraulic umbilical 26 via the internal crossover 18, shear joint 16, and tubing hanger running tool 14. Each of the internal crossover 18, shear joint 16, and the tubing hanger running tool 14 includes passages for the hydraulic and electric connections which, when these parts are mounted on the drill string 20, extend generally parallel to the drill string 20. Stab connections are provided to connect the corresponding passages in adjacent parts.

The various electrical and hydraulic connectors in the umbilical 26 are connected to the passages in the crossover 18 on the drilling rig 24 before the drill string 20 is lowered into the riser. The umbilical 26 is periodically clamped to the drill string 20 as the drill string 20 is lowered. This process is relatively time consuming; clamping the umbilical 26 to the drill string 20 can add approximately 12 hours to the time taken to install the tubing hanger 12, and the process of unclamping the umbilical 26 can take a further 12 hours of rig time during the recovery process.

SUMMARY

An aspect of the present invention is to provide an improved system for and a method of providing connections to a tubing hanger mounted on a subsea wellhead.

In an embodiment, the present invention provides a method of connecting a tubing hanger mounted in a subsea wellhead to equipment which is external to the tubing hanger. The method includes securing the tubing hanger to an end of a drill string using a tubing hanger running tool assembly, lowering the drill string from a drilling rig so as to land the tubing hanger on or in the wellhead, running an umbilical from the sea surface to the wellhead, and connecting the umbilical to at least one conduit in the tubing hanger via the tubing hanger running tool assembly. The umbilical is unconnected to the drill string other than via the tubing hanger running tool assembly.

BRIEF DESCRIPTION OF THE DRAWINGS

The present invention is described in greater detail below on the basis of embodiments and of the drawings in which.

DETAILED DESCRIPTION

Figure 1:
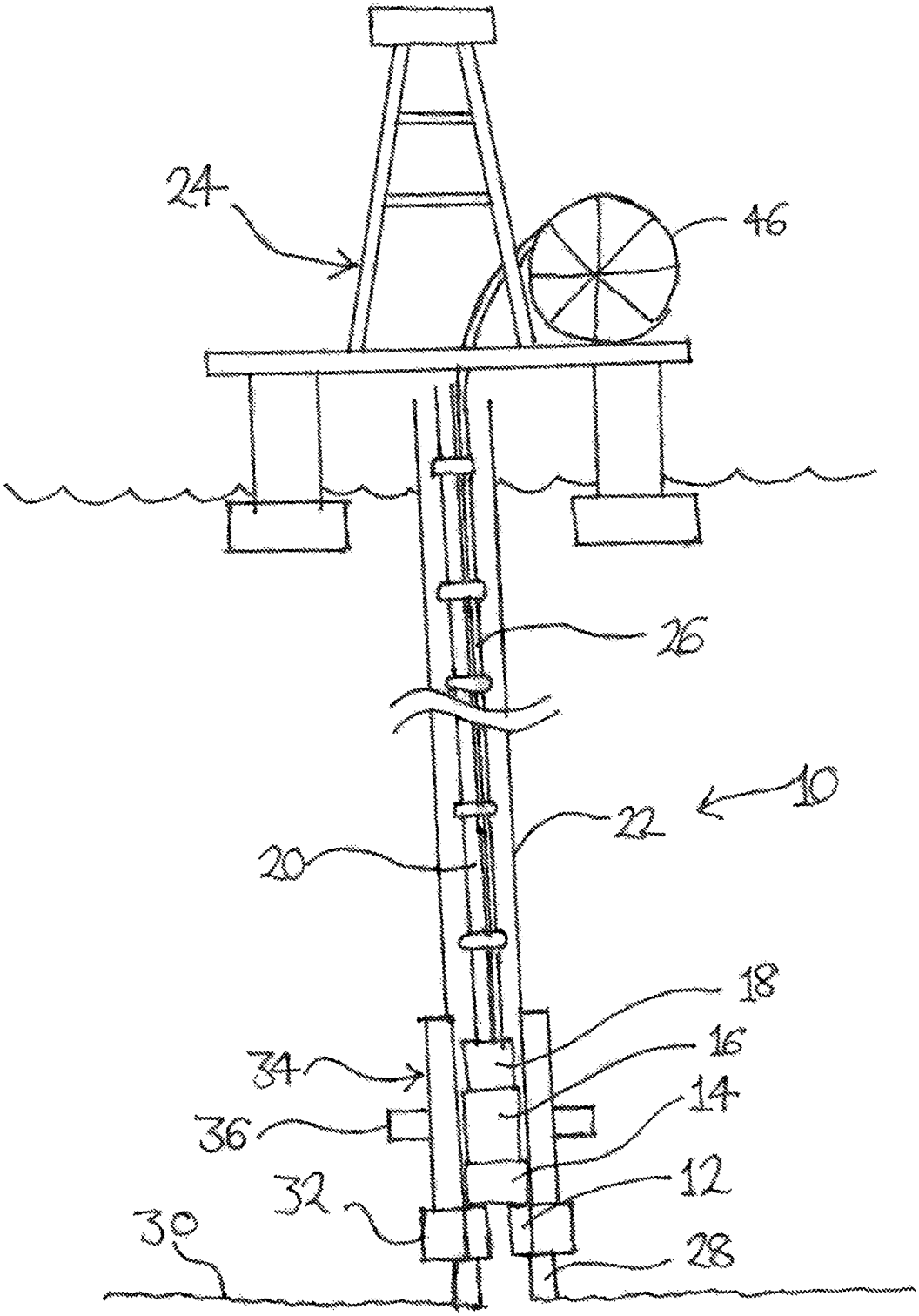
Fig. 1 (Prior Art)
FIG. 1 shows a schematic illustration of an example of a prior art system for landing a tubing hanger on a subsea wellhead.

A first aspect of the present invention provides a method of connecting a tubing hanger mounted on a subsea wellhead to equipment external to the tubing hanger, the method comprising:

a) securing a tubing hanger to an end of a drill string using a tubing hanger running tool assembly, and lowering the drill string from a drilling rig, so as to land the tubing hanger on or in the wellhead; and b) running an umbilical from the sea surface to the wellhead, and connecting the umbilical to conduits in the tubing hanger via the tubing hanger running tool assembly, the umbilical being unconnected to the drill string other than via the tubing hanger running tool assembly.

In an embodiment of the present invention, the drill string can, for example, be lowered to the wellhead inside a riser, the riser extending upwardly from a subsea wellhead to the drilling rig, and the umbilical is run to the wellhead outside the riser. The riser may extend upwards from a blowout preventer stack to the drilling rig.

The umbilical may be connected to the tubing hanger running tool assembly via an external connector which is connected to an external surface of the tubing hanger running tool assembly.

An end of the umbilical may be connected to a subsea umbilical termination assembly at or above sea level, with the subsea umbilical termination assembly being lowered on a cable to the seabed with the umbilical connected thereto until the subsea umbilical termination assembly comes to rest on the seabed. In this case, the subsea termination assembly may be connected to the external connector via at least one electrical or hydraulic flying lead.

The or each flying lead may be connected to the external connector using a remotely operated vehicle.

The umbilical may be lowered to the wellhead from the drilling rig. The umbilical may alternatively be lowered to the wellhead from a separate vessel.

The tubing hanger running tool assembly may have a first end which has the tubing hanger releasably suspended therefrom, a second end which is connected to the drill string, an end face at its first end, and a radially outward facing surface which extends generally perpendicular to the end face, wherein the tubing hanger running tool assembly is further provided with a conduit which extends from the end face to the radially outward facing surface, and which is connected to a corresponding conduit in the tubing hanger.

The tubing hanger running tool assembly may include a tubing hanger running tool at its first end, and a separate crossover part at its second end, the conduits extending from the end face of the tubing hanger running tool to the radially outward facing surface of the crossover part. The conduit in the tubing hanger running tool assembly is in this case formed by a conduit portion in the tubing hanger running tool and a conduit portion in the crossover part, the conduit portions being connected by stab connectors.

The tubing hanger running tool assembly and tubing hanger may be provided with a plurality of such conduits.

The conduit or at least one of the conduits may comprise a passage along which a flow of fluid is permitted.

The conduit or at least one of the conduits may comprise an electrical line.

The method may further comprise, prior to landing the tubing hanger in or on the wellhead, mounting on the wellhead a separate external crossover part which is generally tubular and which has a radially inward facing surface which encloses a generally central space, a radially outward facing surface, and a passage which extends from the radially outward facing surface to the radially inward facing surface, and when lowering the drill string to land the tubing hanger in or on the wellhead, passing the tubing hanger through the generally central space of the external crossover part, and when the tubing hanger is landed in or on the wellhead, aligning the or each conduit emerging from the radially outward facing surface of the tubing hanger assembly with the passage in the external crossover part.

The external connector may be inserted into the passage of the external crossover part from outside the external crossover part to provide an electrical or fluid tight connection to the or each conduit in the tubing hanger running tool assembly.

The external connector may be mounted on the external crossover part before the external crossover part is mounted on the wellhead.

A blowout preventer stack may be mounted on top of the external crossover part.

The tubing hanger may be landed in a tubing hanger support part, which is known as a production adapter base, a tubing hanger spool, or a tubing head spool, which is mounted on top of and secured to the wellhead. Where an external crossover part is used, the external crossover part may be mounted on top of the tubing hanger support part.

A second aspect of the present invention provides a system for providing connections to a tubing hanger mounted in a subsea wellhead, the system comprising a tubing hanger running tool assembly having a first end which is configured to have a tubing hanger releasably suspended therefrom, an end face at its first end, and a radially outward facing surface which extends generally perpendicular to the end face, wherein the tubing hanger running tool assembly is further provided with at least one conduit which extends from the end face to the radially outward facing surface.

In an embodiment, the tubing hanger running tool assembly can, for example, include a tubing hanger running tool at its first end, and a separate crossover part which is at a second end of the assembly, the conduit extending from the end face of the tubing hanger running tool to the radially outward facing surface of the crossover part. The conduit may in this case be formed by a conduit portion in the tubing hanger running tool and a conduit portion in the crossover part, the conduit portions being connected by stab connectors.

The tubing hanger running tool assembly may be provided with a plurality of such conduits.

The conduit or at least one of the conduits may comprise a passage along which a flow of fluid is permitted.

The conduit or at least one of the conduits may comprise an electrical line.

The system may further comprise a separate external crossover part which is generally tubular and which has a radially inward facing surface which encloses a generally central space and a radially outward facing surface, and a passage which extends from the radially outward facing surface to the radially inward facing surface, wherein the external crossover part is sized relative to the tubing hanger running tool assembly so that the tubing hanger running tool assembly fits into the generally central space with the or each conduit emerging from the radially outward facing surface of the tubing hanger assembly into the passage.

The system may further comprise a connector which is adapted to be inserted into the passage of the external crossover part from outside the external crossover part to provide an electrical or fluid tight connection to the conduits in the tubing hanger running tool assembly.

The system may further comprise an umbilical via which the conduits can be connected to surface equipment. The system may in this case further comprise an umbilical termination assembly which is adapted to be connected to the umbilical, and to the connector via one or more flying hydraulic or electrical flying leads.

Embodiments of the present invention will be described below under reference to the drawings.

Figure 2:
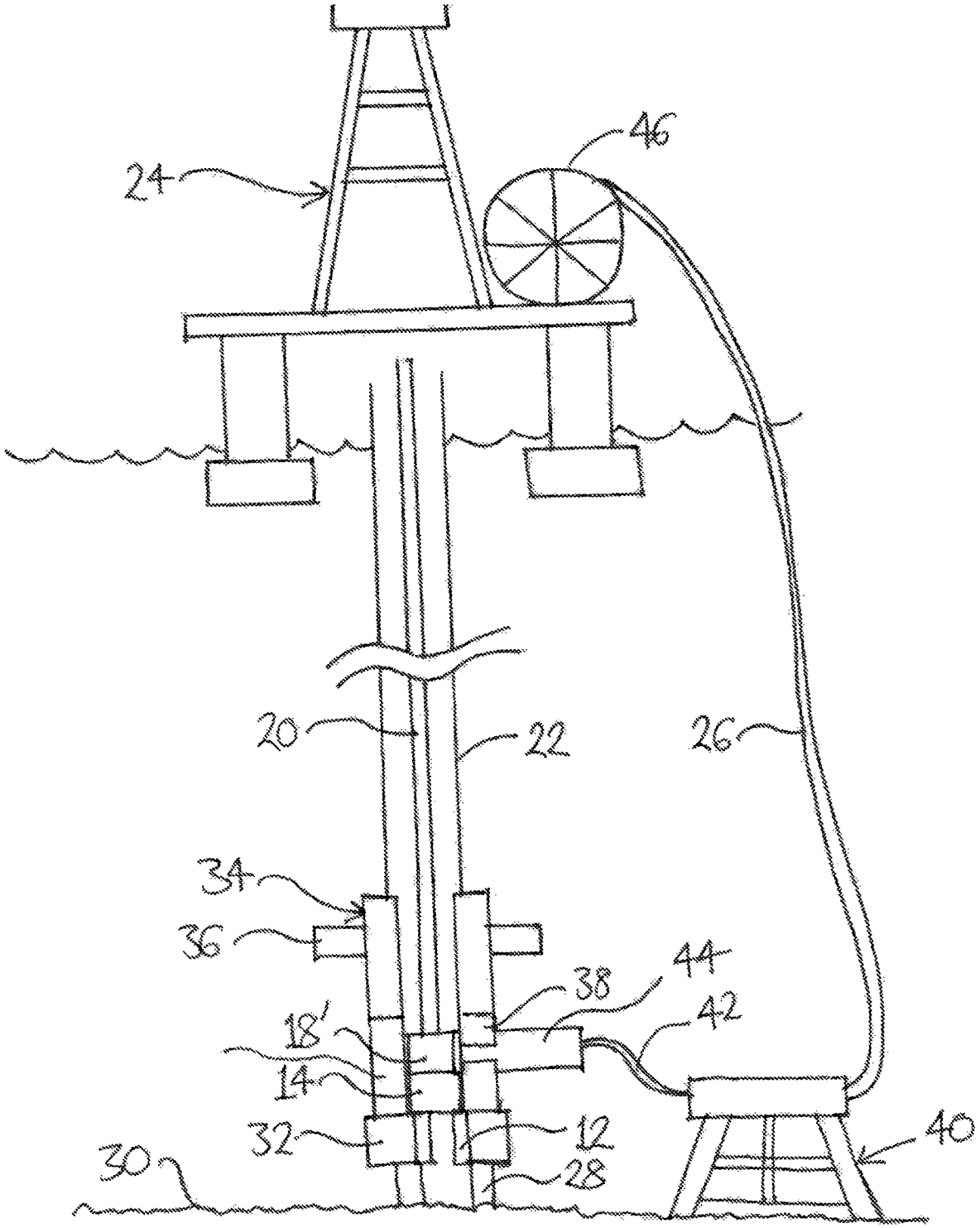
FIG. 2 shows a schematic illustration of a first embodiment of system according the second aspect of the present invention.
Figure 3:
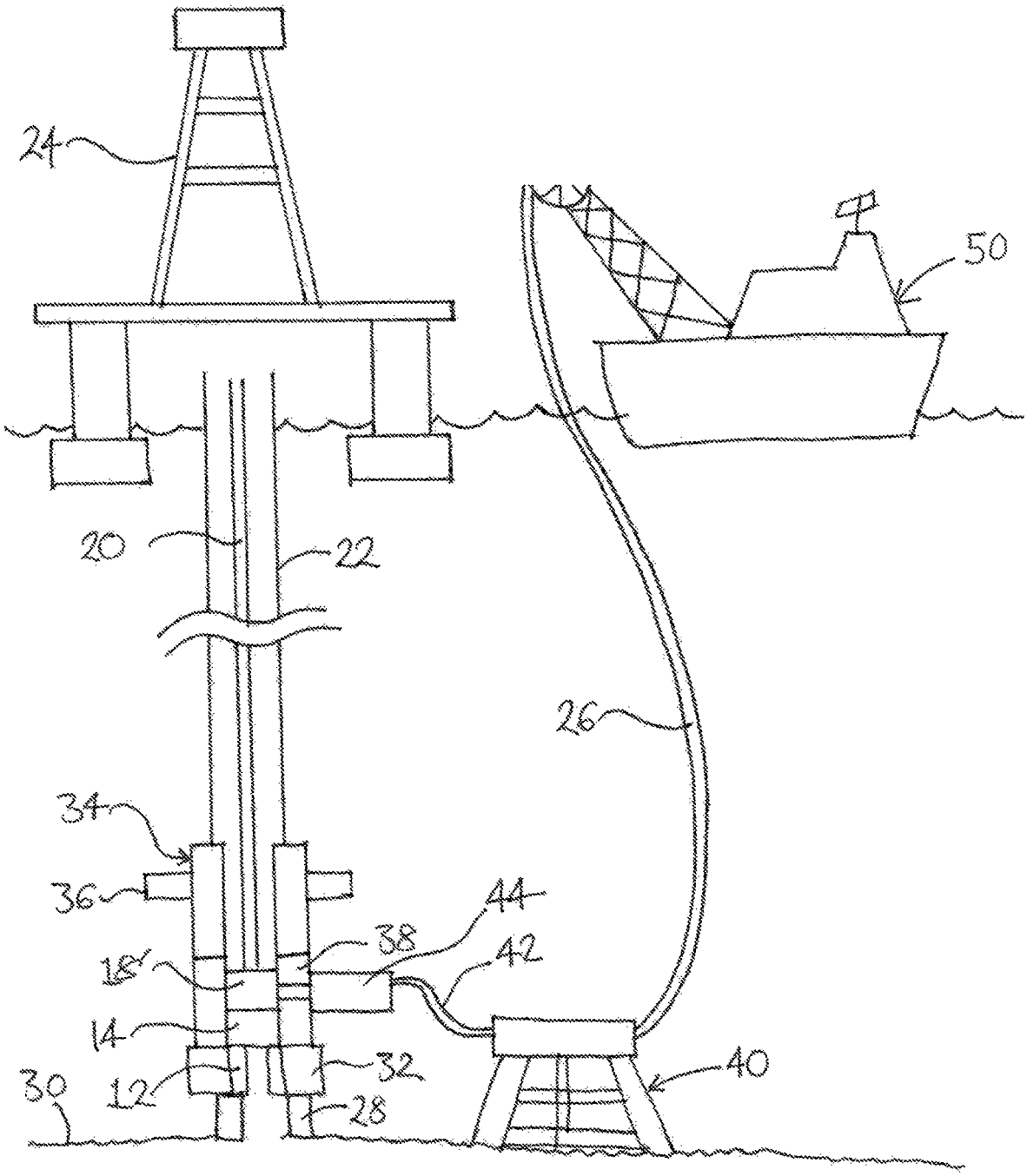
FIG. 3 shows a schematic illustration of a second embodiment of system according to the second aspect of the present invention.

Referring now to FIGS. 2 and 3, there is shown a system 10 for providing connections to a tubing hanger 12 landed in a subsea wellhead 28. The tubing hanger 12 is located in a production adapter base 32 which is mounted on the wellhead 28. The system 10 includes a tubing hanger running tool assembly which, in this example, comprises a tubing hanger running tool 14 and separate crossover part 18', which is hereinafter referred to as the internal crossover 18'. It will be appreciated that whilst these parts are generally separate, and mechanically connected together, they could equally be integrally formed in a single part.

The tubing hanger 12 is mounted on a lowermost end of a drill string 20 via the internal crossover 18' and the tubing hanger running tool 14. The drill string 20 extends down from a drilling rig 24 into a riser 22, the riser 22 extending from the drilling rig 24 to a blowout preventer (BOP) stack 34 which is mounted on top of the production adapter base 32 via a second crossover part 38, which is hereinafter referred to as the external crossover 38. The blowout preventer (BOP) stack 34 has a main passage with a longitudinal axis which is generally aligned with a longitudinal axis of the drill string 20, and includes at least one ram-type BOP 36 which is aligned with the drill string 20 above the internal crossover 18'.

The tubing hanger 12 and the tubing hanger running tool 14 are of conventional construction and each include at least one conduit via which a hydraulic or electrical connection can be made between the tubing hanger 12 and external equipment. It is typically required to provide a plurality of both hydraulic and electrical connections to the tubing hanger for the reasons discussed in the introduction above. In an embodiment of the present invention, a plurality of such conduits can, for example, be provided, some providing electrical connectivity and some providing hydraulic connectivity.

The tubing hanger 12 is conventionally suspended from a lowermost end of the tubing hanger running tool 14.

As is conventional, each conduit in the tubing hanger 12 is connected to a corresponding conduit in the tubing hanger running tool 14, in this example, via a stab connection. These connections are made in adjacent faces of the tubing hanger 12 and tubing hanger running tool 14 which extend generally perpendicular to the longitudinal axis of the blowout preventer (BOP) stack 34, i.e., the face at the uppermost end of the tubing hanger 12 and the face at the lowermost end of the tubing hanger running tool 14.

Each conduit in the tubing hanger running tool 14 is connected to a corresponding conduit 19 in the internal crossover 18', in this example, also by a stab connection. These connections are made in adjacent faces of the tubing hanger running tool 14 and internal crossover 18' which extend generally perpendicular to the longitudinal axis of the blowout preventer (BOP) stack 34, i.e., the face at the uppermost end of the tubing hanger running tool 14 and the face at the lowermost end of the internal crossover 18'.

Figure 4:
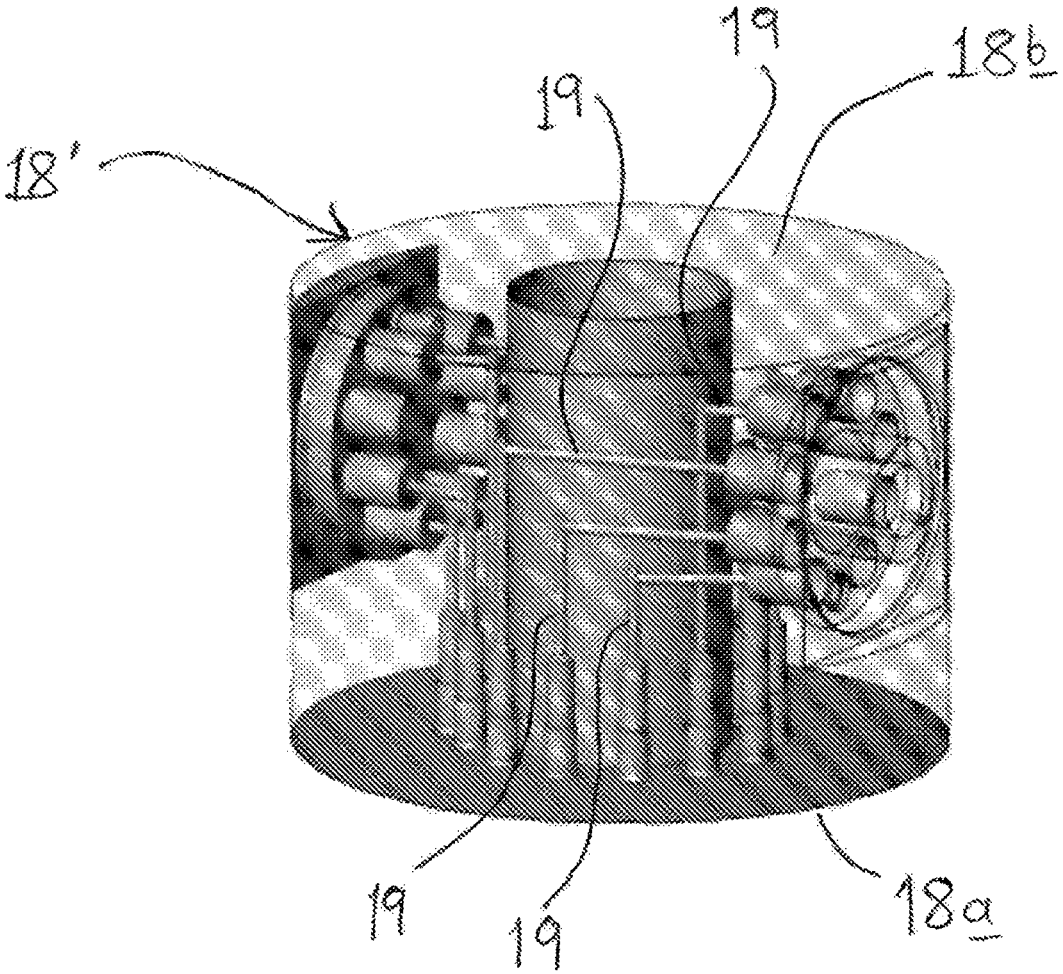
FIG. 4 shows an illustration of the details of the internal crossover used in the systems illustrated in FIGS. 2 and 3.
Figure 5:
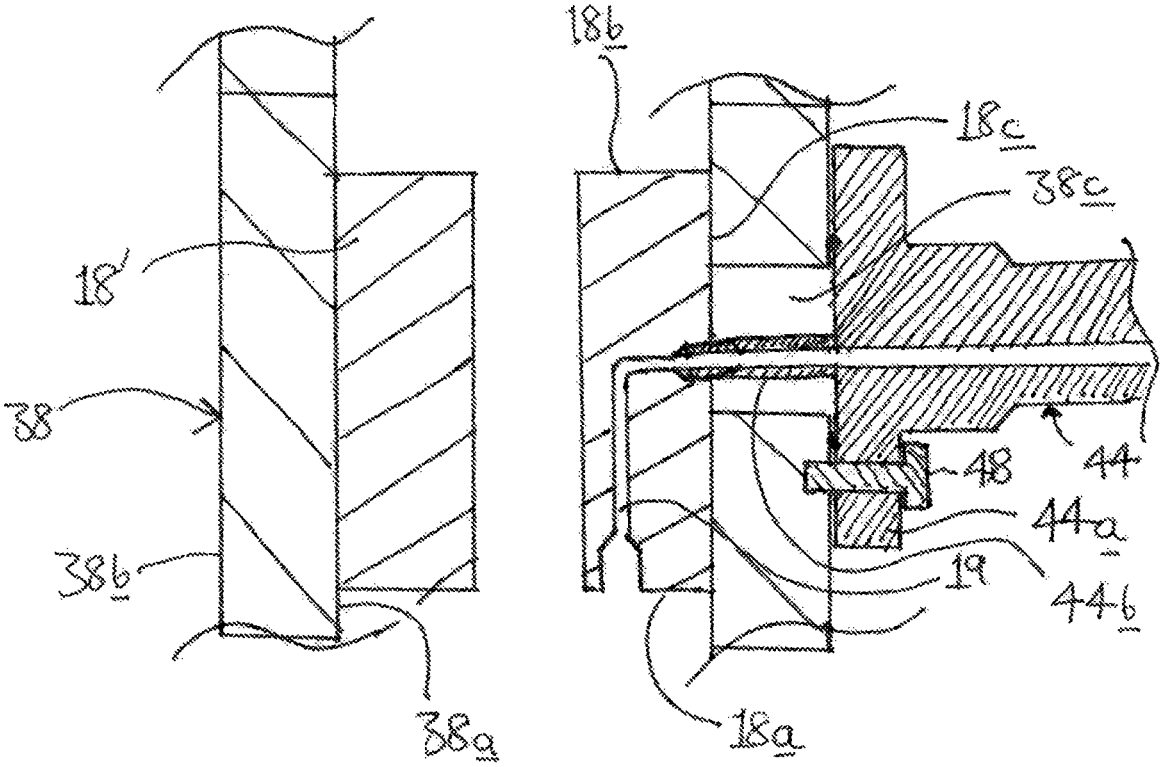
FIG. 5 shows a schematic illustration of a longitudinal cross-section through the internal crossover, external crossover and external connector used in the systems illustrated in FIGS. 2 and 3.

The internal crossover 18' is illustrated in greater detail in FIGS. 4 and 5 and has two generally parallel end faces 18*a*, 18*b* and a side wall 18*c* which extends between the two end faces 18*a*, 18*b*. The internal crossover 18' is generally cylindrical in this example. The internal crossover 18' could, of course, be conical or frusto-conical, provided that the side wall 18*c* is inclined so that the outer diameter of the lowermost end face 18*a* is less than the outer diameter of the uppermost end face 18*b*.

The internal crossover 18' differs from the conventional crossover 18 used in the prior art system described above in that the conduits 19 therein extend from the lowermost end face 18*a*, before turning through approximately 90° (depending on the exact angle between the lowermost end face 18*a* and the side wall 18*c*) to reach the side wall 18*c*.

The external crossover 38 is tubular and has two ends, and a radially inward facing surface 38*a* and a radially outward facing surface 38*b* which extend between the two ends. The system is arranged so that when the tubing hanger 12 is landed in the production adapter base 32, the internal crossover 18' is located in the space enclosed by the external crossover 38.

The external crossover has a passage 38*c* which extends radially from the radially inward facing surface 38*a* to the radially outward facing surface 38*b*, and which is positioned so that the ends of the conduits 19 in the side wall 18*c* of the internal crossover 18' are aligned with the passage 38*c* in the external crossover 38. This means that the conduits in the tubing hanger 12 can be connected to the exterior of the external crossover 38 via the conduits 19 in the internal crossover 18' and the conduits in the tubing hanger running tool 14.

It will be appreciated that each conduit could comprise a passage or bore along which a flow of fluid is permitted, or it could comprise an electrical line.

The system is further provided with an umbilical 26 which is used to connect the conduits in the tubing hanger 12 with the appropriate external equipment. The umbilical 26 is of conventional construction and includes the required number of hydraulic and/or electrical lines to mate with the conduits in the tubing hanger 12.

A first end of the umbilical 26 is located above sea level, whilst a second end of the umbilical 26 is connected, by conventional means, to a subsea umbilical termination assembly 40, hereinafter referred to as SUTA 40, which rests on the seabed 30. The SUTA 40 has ROV panels with multi quick connection plates and electrical connector interface (sockets) via which the hydraulic and electrical lines in the umbilical 26 may be connected to hydraulic and electrical flying leads.

The SUTA 40 is connected to the conduits 19 in the internal crossover 18' by hydraulic and/or electrical flying leads 42 and an external connector 44. As illustrated in FIG. 5, the external connector 44 has a plurality of individual hydraulic or electrical stab connectors 44*b* each one of which extends along the passage 38*c* in the external crossover 38 into one of the conduits 19 in the internal crossover 18'.

In this example, the external connector 44 is generally cylindrical, having a longitudinal axis which is arranged generally perpendicular to the longitudinal axis of the blowout preventer (BOP) stack 34. It also has a radially outwardly extending flange 44*a* via which the external connector 44 may be secured, using a plurality of bolts 48, to the radially outward facing surface 38*b* of the external crossover 38 around the passage 38*c*, as illustrated in FIG. 5. It also includes a plurality of stab connectors 44*b*, one for each hydraulic or electrical connection to be made, which are movable between a retracted position and an extended position. This actuation of external connector could be performed hydraulically or mechanically (torque/rotation) by a ROV.

By utilizing the inventive system, the tubing hanger 12 may be installed in the production adapter base 32 as follows.

The external connector 44 is secured to the external crossover 38, using the bolts 48, at the surface, either on the drilling rig 24 or on a separate vessel 50. At this point, the stab connectors 44*b* in the external connector 44 are retracted so that they extend only into the passage 38*c* of the external connector 44, and not into the volume enclosed by the radially inward facing surface 38*a*.

The external crossover 38 is then mounted on top of the production adapter base 32, the blowout preventer (BOP) stack 34 is secured on top of the external crossover 38, and the lowermost end of the riser 22 secured to the top of the blowout preventer (BOP) stack 34. The tubing hanger 12 is mounted on the end of the drill string 20 via the tubing hanger running tool 14 and the internal crossover 18', and the drill string 20 is lowered into the riser 22 from the drilling rig 24 until the tubing hanger 12 is landed in the production adapter base 32. The production adapter base 32 is provided with a shoulder on which the tubing hanger 12 comes to rest. The shoulder is in the form of a helix (single or double helix) which assists in providing that the conduits 19 are aligned with the passage 38*c* in the external connector 38 when the tubing hanger 12 comes to a rest. The stab connectors 44*b* in the external connector 44 can then be extended along the passage in the external connector 44 to engage with the conduits 19 in the internal crossover 18' as illustrated in FIG. 5.

This is performed without clamping the umbilical 26 to drill string 20 so that a weaker drill string 20 may be used with than in the prior art method discussed above. This weaker drill string 20 can be severed by operating a ram-type BOP 36 in the blowout preventer (BOP) stack 34. It is therefore not necessary to provide a shear joint 16 between the internal crossover 18 and the tubing hanger running tool 14 as in the prior art arrangement illustrated in FIG. 1. This simplifies the installation procedure and reduces the number of interfaces in the system, and hence reduces the number of stab connectors required to make the necessary connections to the conduits in the tubing hanger 12.

Avoiding the need to clamp the umbilical 26 to the drill string 20 may also significantly decrease the time taken to land the tubing hanger 12 in the production adapter base 32, which has significant cost benefits, as well as reducing the amount of activity in the moon pool during the installation procedure, which improves the safety of the procedure. Finally, in the prior art process, there is a risk that one or more of the clamps used to secure the umbilical 26 to the drill string 20 may fall into the well bore, and would need to be retrieved, thus adding to the installation time, and cost, of the procedure. This problem is avoided by using the inventive system.

The umbilical 26 is connected to the SUTA 40 above sea level, and the SUTA 40 is suspended from a cable, to which the umbilical is clamped, and lowered to the seabed 30 using a conventional "Launch and Recovery System" which comprises a winch, a heave compensator, and an umbilical reel 46. When the SUTA 40 is in place, the connections between the SUTA 40 and the external crossover are made using at least one remotely operated vehicle (ROV), which secures the external connector 44 to the SUTA 40 via the appropriate number of hydraulic or electrical flying leads to provide the desired number and type of connections from surface to the tubing hanger.

The inventive system therefore separates the procedure of landing the tubing hanger 12 in the production adapter base 32 from the process of making the electrical and/or hydraulic connections to the tubing hanger 12 so that the two processes can be carried out simultaneously or at different times, depending on what fits in best with the overall completion process.

The launch and recovery system may be mounted on the drilling rig 24 as illustrated in FIG. 2, or on a separate vessel 50 as illustrated in FIG. 3. Using a separate vessel 50 may be advantageous as it frees up space on the drilling rig 24 and facilitates quicker movement of the launch and recovery system for use in a different operation or on a different site.

The present invention is not limited to embodiments described herein; reference should be had to the appended claims.

What is claimed is:

1. A method of connecting a tubing hanger mounted in a subsea wellhead to equipment which is external to the tubing hanger, the method comprising:

securing the tubing hanger to an end of a drill string using a tubing hanger running tool assembly;

lowering the drill string from a drilling rig so as to land the tubing hanger on or in the wellhead;

running an umbilical from a sea surface to the wellhead by connecting an end of the umbilical to a subsea umbilical termination assembly at or above sea level, using a cable to lower the subsea umbilical termination assembly, with the umbilical attached, to the sea bed so that the subsea termination assembly comes to rest on the sea bed, the umbilical having a plurality of conduits; and connecting each of the plurality of conduits in the umbilical to one of a plurality of conduits in the tubing hanger via one of a plurality of conduits in the tubing hanger running tool assembly via an external connector which is connected to an external surface of the tubing hanger running tool assembly and at least one electrical or hydraulic flying lead which extends from the subsea umbilical termination assembly to the external connector, wherein, the umbilical is unconnected to the drill string other than via the tubing hanger running tool assembly.

2. The method as recited in claim 1, wherein, the lowering of the drill string from the drilling rig so as to land the tubing hanger on or in the wellhead is performed inside a riser which extends upwards from the subsea well head to the drilling rig, and the running of the umbilical from the sea surface to the wellhead is performed outside the riser.

3. The method as recited in claim 1, wherein the at least one electrical or hydraulic flying lead is connected to the external connector using a remotely operated vehicle.

4. The method as recited in claim 1, wherein the tubing hanger running tool assembly comprises:

a first end which has the tubing hanger releasably suspended therefrom;

a second end arranged opposite to the first end, the second end being connected to the drill string;

an end face at the first end;

a radially outward facing surface which extends generally perpendicular to the end face; and a plurality of conduits which extend from the end face to the radially outward facing surface and which are connected to a corresponding conduit in the tubing hanger.

5. The method as recited in claim 4, wherein the tubing hanger running tool assembly further comprises:

a tubing hanger running tool at the first end; and a separate crossover part at the second end;

wherein, the plurality of conduits extend from the end face of the tubing hanger running tool to a radially outward facing surface of the separate crossover part.

6. The method as recited in claim 5, wherein the plurality of conduits in the tubing hanger running tool assembly are each formed by a conduit portion in the tubing hanger running tool and by a conduit portion in the separate crossover part which are connected via a stab connector.

7. The method as recited in claim 4, wherein at least one of the plurality of conduits comprises a passage which is configured to permit a flow of a fluid.

8. The method as recited in claim 4, wherein at least one of the plurality of conduits comprises an electrical line.

9. The method as recited in claim 4, further comprising:

prior to landing the tubing hanger in or on the wellhead, mounting on the wellhead an external crossover part which is generally tubular and which comprises, a radially inward facing surface which encloses a generally central space, a radially outward facing surface, and a passage which extends from the radially outward facing surface to the radially inward facing surface;

when lowering the drill string to land the tubing hanger in or on the wellhead, passing the tubing hanger through the generally central space of the external crossover part; and when the tubing hanger is landed in or on the wellhead, aligning the plurality of conduits emerging from the radially outward facing surface of the tubing hanger running tool assembly with the passage in the external crossover part.

10. The method as recited in claim 9, wherein the external connector is inserted into the passage of the external crossover part from outside the external crossover part so as to provide an electrical connection or a fluid tight connection to the plurality of conduits in the tubing hanger running tool assembly.

11. The method as recited in claim 10, wherein the external connector is mounted on the external crossover part before the external crossover part is mounted on the wellhead.

12. The method as recited in claim 9, wherein a blowout preventer stack is mounted on top of the external crossover part.

13. The method as recited in claim 9, wherein the tubing hanger is landed in a tubing hanger support part which is mounted on top of and which is secured to the wellhead.

14. The method as recited in claim 13, wherein the external crossover part is mounted on top of the tubing hanger support part.

* * * * *